US005107964A

United States Patent [19]

Coste et al.

[11] Patent Number: 5,107,964

[45] Date of Patent: Apr. 28, 1992

[54] SEPARATE ELEVATOR DOOR CHAIN

[75] Inventors: Steven D. Coste, Berlin; Eric K. Jamieson, Farmington, both of Conn.

[73] Assignee: Otis Elevator Company, Farmington, Conn.

[21] Appl. No.: 520,003

[22] Filed: May 7, 1990

[51] Int. Cl.[5] ..... B66B 13/24

[52] U.S. Cl. ..... 187/104; 187/130

[58] Field of Search ..... 187/100, 105, 103, 133, 187/130

[56] References Cited

U.S. PATENT DOCUMENTS

| | | | |
|---|---|---|---|
| 4,101,007 | 7/1978 | Magee | 187/105 |
| 4,367,810 | 1/1983 | Doane et al. | 187/100 |
| 4,568,909 | 2/1986 | Whynacht | 187/133 |
| 4,750,591 | 6/1988 | Coste et al. | 187/130 |
| 4,832,158 | 5/1989 | Farrar et al. | 187/103 |

*Primary Examiner*—A. D. Pellinen
*Assistant Examiner*—Lawrence E. Colbert
*Attorney, Agent, or Firm*—Francis J. Maguire, Jr.

[57] ABSTRACT

Elevator door chain contacts are isolated from the safety chain in a separate circuit, thus enabling the use of a separate door chain coil for independently checking the status of the door chain itself and for enabling the remainder of the safety chain. The status of the door chain itself may be checked to make sure the doors are all closed when they should be. If it is determined the door are not all shut, the car door may be cycled open and shut in an attempt to correct a possible problem at the landing. The individual hoistway door contacts in the door chain may be checked, one at a time, while the car doors are fully opened at each particular floor to make sure that the door chain is not being incorrectly shorted, i.e., to make sure the hoistway door switch contact at the particular floor is opening when it should. A checking contact may be wired into the door chain and used to selectively open circuit the door chain to ensure that the door chain coil is not directly shorted to the power supply. Since the door chain contacts are isolated from the safety chain in a separate circuit, the length of wire and the number of connections between the AC supply and the object relay coil can be reduced in both the door chain itself and the remaining part of the safety chain.

19 Claims, 3 Drawing Sheets

SEPARATE ELEVATOR DOOR CHAIN

TECHNICAL FIELD

This invention relates to elevators and, more particularly, to safety chains therefor.

BACKGROUND ART

Elevator systems have long utilized safety chains of hard-wired relay contacts which must essentially all be made prior to moving the elevator car. Early relays used for the safety chain were DC because AC relays were not as reliable. Since installed elevator systems typically have a very long life span, even longer than the lifespan of then available commercial DC relays, many elevator companies chose to make their own DC relays to better control reliability and quality.

However, as commercial AC relays have improved in reliability, and the cost of maintaining an in-house DC relay manufacturing capability has increased, elevator companies have gradually shifted to use of AC relays for circuits in which hard-wired logic is still desirable or necessary, such as in safety chains. Most US domestic companies have chosen to use 220 Volt, 60 cycle AC for such relay logic circuits, although at least one well-known company has selected 110 VAC which, although presenting less of a voltage hazard, creates a voltage drop problem in long wire runs with numerous hookup points and inductive losses. [Current systems employing combined door and safety chains present a problem regarding the cumulative voltage drop over large distances of wire (that are run throughout the hoistway and travelling cable, etc.) with numerous hookup points. The voltage must be of sufficient magnitude to supply a voltage capable of sustaining a relay coil.]

An early microprocessor-based elevator system of the Otis Elevator Company utilized DC relay logic in the safety chain and had a "DST" (Door Status) relay which was energized when all the door contacts in the door portion of the safety chain were made. A blocking diode was used to obtain isolation of the relay from the door chain bypass circuit and the rest of the safety chain. (Such a bypass circuit is designed to short-circuit the door portion of the safety chain when the car is in a door zone and moving at a slow rate). In this way, a contact of the DST relay may be sampled by the microprocessor-based controller. A check was made of the DST contact upon receiving a door fully open indication. The necessary circuit isolation for the DST relay (a blocking diode) was made possible by the unidirectional quality of the DC supply.

DISCLOSURE OF INVENTION

According to the present invention, the door chain contacts are isolated from the safety chain in a separate circuit, thus enabling the use of a separate door chain coil for independently checking the status of the door chain.

In further accord with the present invention, a status checking contact, for checking the status of the door chain coil, may be wired into the door chain. It may be used to open circuit the door chain at a selected time to ensure that the door chain coil is not shorted to the power supply. The status checking contact may be part of or associated with a relay coil that may be controlled by a processor. This check may be done prior to each run. In the event an improperly energized coil is detected, the elevator car is inhibited from moving.

In still further accord with the present invention, the status of a separate door chain may be checked periodically to make sure the doors are all closed when they should be. For example, a check may be made at the time a new run has begun or is about to begin, to make sure the doors are all closed before allowing the run to commence. The door chain status may be checked by making sure the door chain coil is energized. If it is determined the doors are not all shut, in accord with the present invention, the car door may cycled open and shut in an attempt to correct a possible problem at the landing.

In further accord with the present invention, the individual hoistway door contacts in the door chain may be checked, one at a time, while the car doors are fully opened at each particular floor to make sure that the door chain is not shorted, i.e., to make sure the hoistway door switch contact at the particular floor is opening when it should.

According still further to the present invention, the door chain contacts are isolated from the safety chain in a separate circuit, such that the length of wire and the number of connections between the AC supply and the object relay coil is reduced in both the door chain itself and the remaining part of the safety chain.

In the prior art, redundancy was not provided for single failure detection, nor was a means provided for testing the "DST" relay function for proper operation prior to every run. (A check was made of the DST contact upon receiving a door fully open indication). The necessary circuit isolation for the DST relay (a blocking diode) was made possible by the unidirectional quality of the DC supply.

In accord with the teachings of the present invention, it is recognized that a microprocessor-based system using AC relays cannot provide for monitoring of the door chain status with an AC relay using a blocking diode for isolation because of the bidirectional nature of AC. Thus, at least with the old approach, there would be no way to confirm that the safety chain would be retained upon opening the bypass circuit at the beginning of the next run. In addition, if the entire door chain were jumpered out or otherwise shorted, the controller would be unable to detect this condition and would potentially allow running the car with open hoistway doors.

In addition, without having the capability to check the door chain status at the beginning of a run, the motion controller would cause the bypass circuit to be opened without a guarantee that the car and hoistway door switch contacts in the safety chain were made. For example, if they were not made at the time the door cam signals indicated that the doors were fully closed and, as a result of a demand signal, the bypass circuit were subsequently opened, a nuisance shutdown would occur because of the open circuit condition of the door chain portion of the safety chain. One way to cure this problem, according to the present invention, is to provide the control software with door chain status information to allow it to provide the failure management necessary in rectifying an open door chain due to door locks that don't seat properly, etc., by recycling the door before a run is allowed to progress.

These and other objects, features and advantages of the present invention will become more apparent in light of the following detailed description of a best mode embodiment thereof, as illustrated in the accompanying drawing.

BEST MODE FOR CARRYING OUT THE INVENTION

The use of a long chain of contacts in a series circuit or safety chain to prevent car movement unless certain conditions are met is typical and old in the art. It is still typical even on modern, microprocessor-controlled elevator controls.

As far as known by us, however, the use of a separate series circuit for the hoistway doors is not known for modern controls. Although the Otis Elevator Company utilized a separate DC door chain in its UMV series of relay controlled elevators in the late nineteen-forties and early fifties, such a separate chain has long since been discontinued. Separate circuits were used in the UMV series and their predecessors, presumably to reduce the DC voltage drop in the safety chain and to separate the hoistway door switches from the rest of the safety chain to enable easier manual isolation of a door chain fault from a fault in another portion of the safety chain.

The present invention has been implemented on a modern, microprocessor-based control as disclosed in the best mode disclosure hereinafter. The separation of the door chain from the rest of the safety chain is the best way of carrying out the invention herein disclosed and claimed, as distinguished from the above described prior circuits.

As mentioned previously, in accord with the teachings of the present invention, a contact of a door chain coil (energized by closure of the door chain contacts) may be used in the safety chain while another may be used for monitoring of the door chain status.

Figure 1:
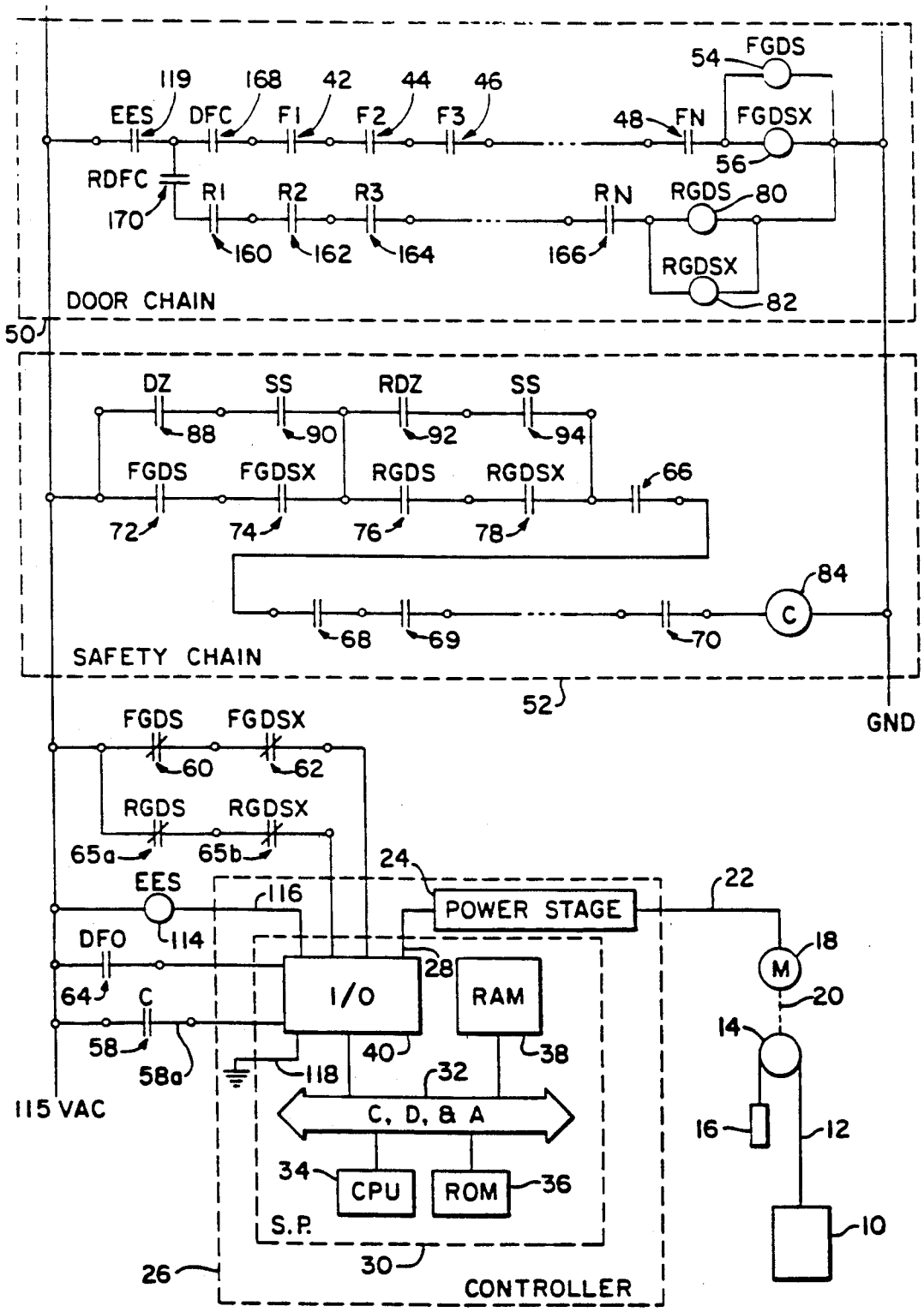
FIG. 1 illustrates an elevator system incorporating features according to the teachings of the present invention.

Referring now to FIG. 1, an illustration of an elevator system incorporating features according to the teachings of the present invention is shown. An elevator car 10 is attached by means of a rope 12 over a sheave 14 to a counterweight 16. A motor 18 drives the sheave 14 by means of a mechanical coupling 20. The motor 18 is in turn actuated by a power signal 22 provided by a power stage 24 in an elevator controller 26. The power stage 24 is responsive to a source of external power (not shown) and is responsive to a control signal on a line 28 from a signal processor (SP) 30. The SP 30 may be a part of the controller 26 as shown in FIG. 1 but may of course be in a separate controller.

The SP may include a control, data and address bus 32 which is in communication with a central processing unit (CPU) 34, a read only memory (ROM) 36, a random access memory (RAM) 38 and an input/output (I/O) port 40.

As mentioned previously, it is known in the art to provide a series circuit of contacts for energizing a permissive relay only if all the contacts in the series circuit or safety chain are closed. The contacts in a closed or open state typically represent conditions under which, respectively, it is or isn't permissible to operate the elevator. Such would include making sure all the hoistway doors at the various landings in the building are closed, as well as the car door, among other things. Energization of the safety chain's permissive relay provides a permissive signal to a controller which permits an associated car to be moved. It is known to bypass the lack of a permissive signal under certain conditions (e.g., the car is within a hoistway door zone and is moving at less than a certain relatively slow speed) to allow the commencement of door opening shortly before arrival at a floor.

According to the present invention, the door chain contacts are isolated from the safety chain in a separate circuit, to enable the door chain portion of the safety chain to be checked prior to, at or after the commencement of a run (but before motion fully commences). For example, a series of front hoistway door contacts 42, 44, 46, . . . , 48 (F1, F2, F3, . . . , FN) may form a door chain circuit 50 isolated from a safety chain 52, thus enabling the use of a separate coil 54, which we call a door safety chain relay coil, for independently checking the status of the door chain. A redundant coil 56 may be provided for the sake of increasing reliability. A second door chain may be wired in parallel, as shown, for rear doors, if applicable.

At the time a new run is begun, the door chain status may be checked independently of the safety chain relay permissive logic by the processor to make sure the doors are all closed before allowing the run to actually commence movement. If a determination is made prior to commencing movement that the doors are not all shut, the car door may be cycled open and shut in an attempt to correct a possible switch problem at the car landing. This approach might prevent a delay that would otherwise be caused if the bypass circuit were opened and a hoistway contact were for some reason not quite closed or just open, thereby causing a nuisance shutdown. Thus, the SP 30 monitors the safety chain 52 by means of a contact 58 and monitors the door chain 52 by means of a contact of the relay 54, for example, by means of an FGDS (front gate door status) contact 60 and, optionally, by means of a backup FGDSX relay contact 62 (both indicative when closed that the door chain is open) in series.

A check of the FGDS and FGDSX (front gate and door status relay and auxiliary) contacts may be made when a related (contrariwise) condition such as a car door fully open (DFO) condition is detected by means, for example, of a car DFO contact 64. If the door chain is indicated as being shorted (either FGDS contact 60 or FGDSX contact 62 or both being open) while a DFO condition is also indicated (by DFO contact 64 being closed) then the car should not be permitted to move. Such a check may be made, for example, before beginning a run.

As mentioned, a benefit of the above described approach of separating the door chain from the rest of the safety chain is that the length of wire and the number of connections between the AC supply and the object relay coil is reduced in both the door chain itself and the remaining part of the safety chain. This enables the building owner to supply a lesser voltage to the elevator thereby reducing the magnitude of the voltage to which electricians and other electrical workers may be exposed.

The safety chain 52 includes a series of contacts 66, 68, . . . , 70 which may be related to various permissive conditions. These may be wired in series with one or door chain relay permissive more contacts 72, 74 respectively associated with coils 54, 56, and contacts 76, 78 respectively associated with rear door relay coils 80, 82. The contacts 72, 74, 76, 78 are altogether indicative of the front and rear hoistway door chains' states. Thus, the series of contacts 72, 74, 76, 78 must (except when bypassed) be closed in order to energize a safety chain relay coil 84. Again, the normally open contact 58, which is a contact of an AC safety chain relay coil 84, is monitored by the S.P. 30; when closed, contact 58 provides a signal on a line 58*a* that the SP uses to permit the elevator car 10 to be moved by the motor 18. The contact 58, being open circuited, will result in the absence of 115 VAC on the signal line 58*a* and will, in that event, constitute a car motion inhibit signal used by the SP to inhibit car motion.

As mentioned, the contacts 72, 74, 76, 78 may be bypassed by a plurality of contacts 88, 90, 92, 94. Contacts 88, 92 are indicative of the car being within a short distance of a landing. Contacts 90, 94 are indicative of the car running at or below a selected slow speed. When the car is both at or below the slow speed within the selected door zone, then contacts 88, 90, 92, 94 will short out the door chain contacts 72, 74, 76, 78 and the car may be moved even though the doors are not completely closed. The bypass circuit is useful in permitting advance door opening for an impending floor stop.

It should be understood that most elevators will have an extra car door fully open switch auxiliary contact such as contact 64 available. If such is not available, another function may be selected for checking purposes Thus, instead of car DFO, another independent contact could be used as a contrariwise indication of proper safety chain status.

The coils 54, 56, 84, etc., and their associated contacts 60, 62, 58, etc., comprise relays or their equivalents and may of course (and would typically) be located in a controller such as the controller 26. Thus, although illustrated within and without various "safety chains" and other control circuits, and although the physical locations of the relays themselves are certainly of importance when considering wiring run lengths and similar factors, it should be understood that their locations are not necessarily relevant to the invention claimed herein. The coil 84, for example, is shown as part of a "safety chain" 52 for the purpose of identifying the safety chain as a functional entity and for facilitating the teaching of the function. In reality the safety chain 52 is a series circuit having components mounted in various locations and not necessarily mounted within any particular enclosure.

It should also be understood that relay contacts or their equivalents may be independently monitored in any number of ways by the signal processor 30. For purposes of understanding the scope of the claimed invention, such independent methods, as well as the particular method disclosed herein, which are well within the skill of the art, are not particularly relevant and should therefore be regarded as equivalent. Thus, although FIG. 1 depicts the use of relays with their peculiar hard-wired connections, it will be understood that equivalent methods are certainly contemplated as being within the scope of the claimed invention. Such would include, for example, in a system devoid of relays such as solid state, the use of other means of sensing, logic means and software methods.

It will be understood by those skilled in the art that various methods of monitoring may include the use of opto-isolators, analog-to-digital converters, etc., and that various other signal conditioning steps may be necessary to isolate, convert, or otherwise provide a signal indication of the condition of the safety chain in a form suitable for the SP.

It will be understood by those skilled in the art of writing software for elevator control systems that a microprocessor-based elevator will be controlled by means of a series of repeated information gathering (input) and control signal (output) time frames. For example, a time frame may comprise 200 milliseconds so that the same information gathering and control steps are carried out five times per second. Each 200 millisecond time frame may be further subdivided into, for example, 50 millisecond subframes. The more critical input and output functions may be accomplished at the beginning of each subframe and the rest of each subframe can be dedicated to tasks that are designated as noncritical.

Figure 2:
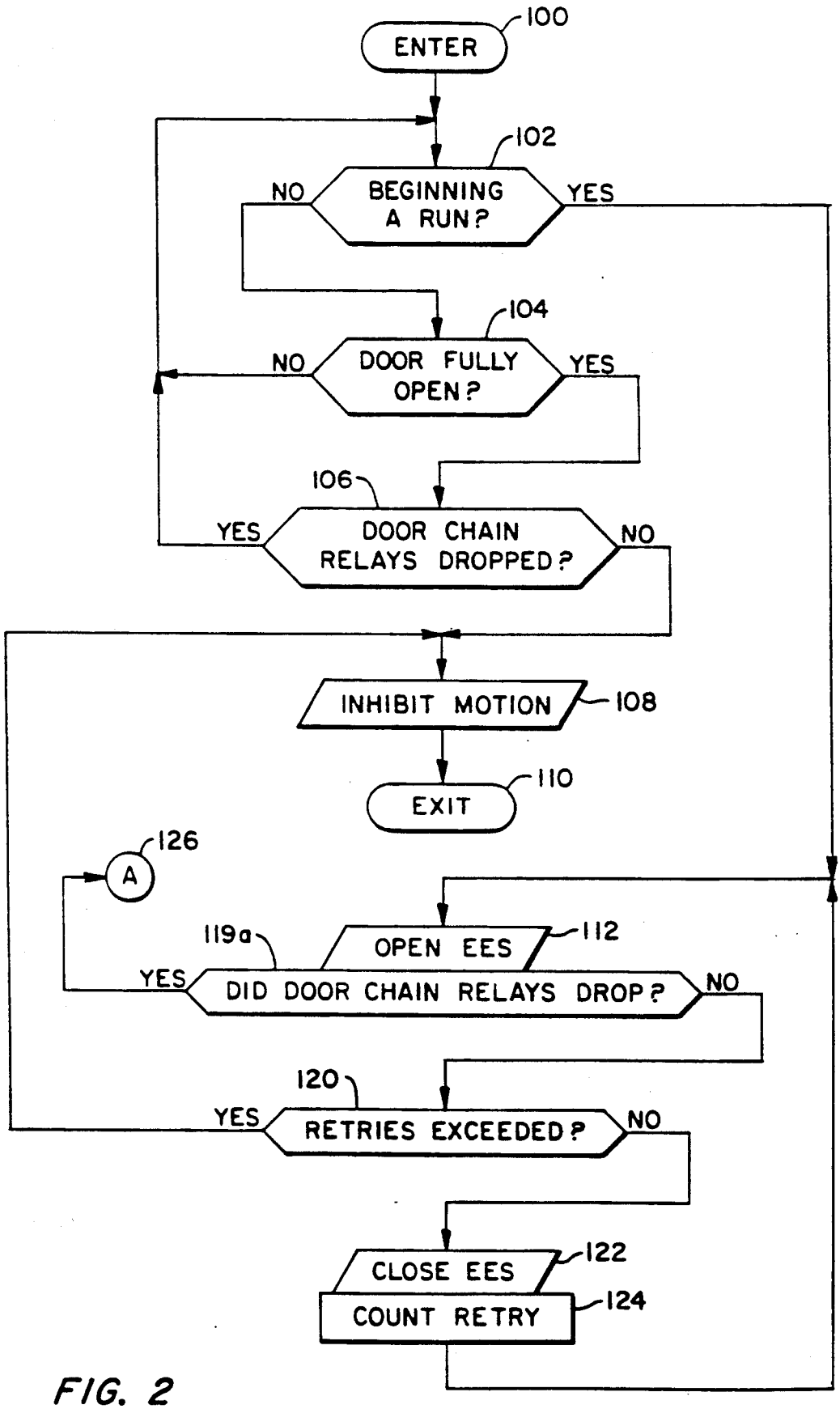
FIGS. 2 and 3 are illustrations of steps which may be executed by the signal processor of FIG. 1, according to the present invention.

FIG. 2 is a flow chart illustration of a number of steps which may be carried out in the signal processor 30 of FIG. 1, according to the present invention. After entering in a step 100, a determination is made in a step 102 as to whether or not the elevator controller is beginning a run. If not, a step 104 is next executed in which a determination is made as to whether or not the car door is fully open. This would be indicated by the DFO contact 64 of FIG. 1. If not, step 102 is reexecuted. If so, a step 106 is next executed in which a determination is made as to whether or not the door chain relays are dropped. By this is meant whether or not the relays 54, 56, 80, 82 are de-energized. In other words, whether the door switch at the floor is open, as it should be. If so, as indicated by contacts 60, 62, 65*a*, 65*b* being closed, step 102 is reexecuted. If not, there may be something wrong with the doors, car motion is therefore inhibited as indicated by a step 108 and an exit is made in a step 110.

If it were determined in step 102 that a run was beginning, then a step 112 would be executed instead of step 104 and an EES (electronic emergency stop relay, microprocessor controlled) relay coil 114 would be disconnected from ground by the signal processor 30. This would be accomplished by removing a line 116 from connection to a line 118 to ground. By de-energizing coil 114, a checking contact 119 becomes open circuited and the signal processor is then in a position to check, in a step 119*a*, whether or not the door chain relays dropped out when the EES contact 119 became open circuited. It does this by checking whether 115 volts AC is present at the inputs to the signal processor input/output port 40 connected to contacts 60, 62 and 65*a*, 65*b*. If it is determined in step 119*a* that the door chain relays did not drop out when the EES checking contact 119 was opened circuited, this could indicate that the coils are shorted to the AC source. But, in order to make sure this was not a temporary phenomenon or an erroneous indication, a number of retries is and a series of steps 120, 122, 124 are reexecuted several times until the step 120 determines that the number of retries has been exceeded. If such occurs, step 108 is executed to inhibit elevator car motion and an exit is made in step 110.

Figure 3:
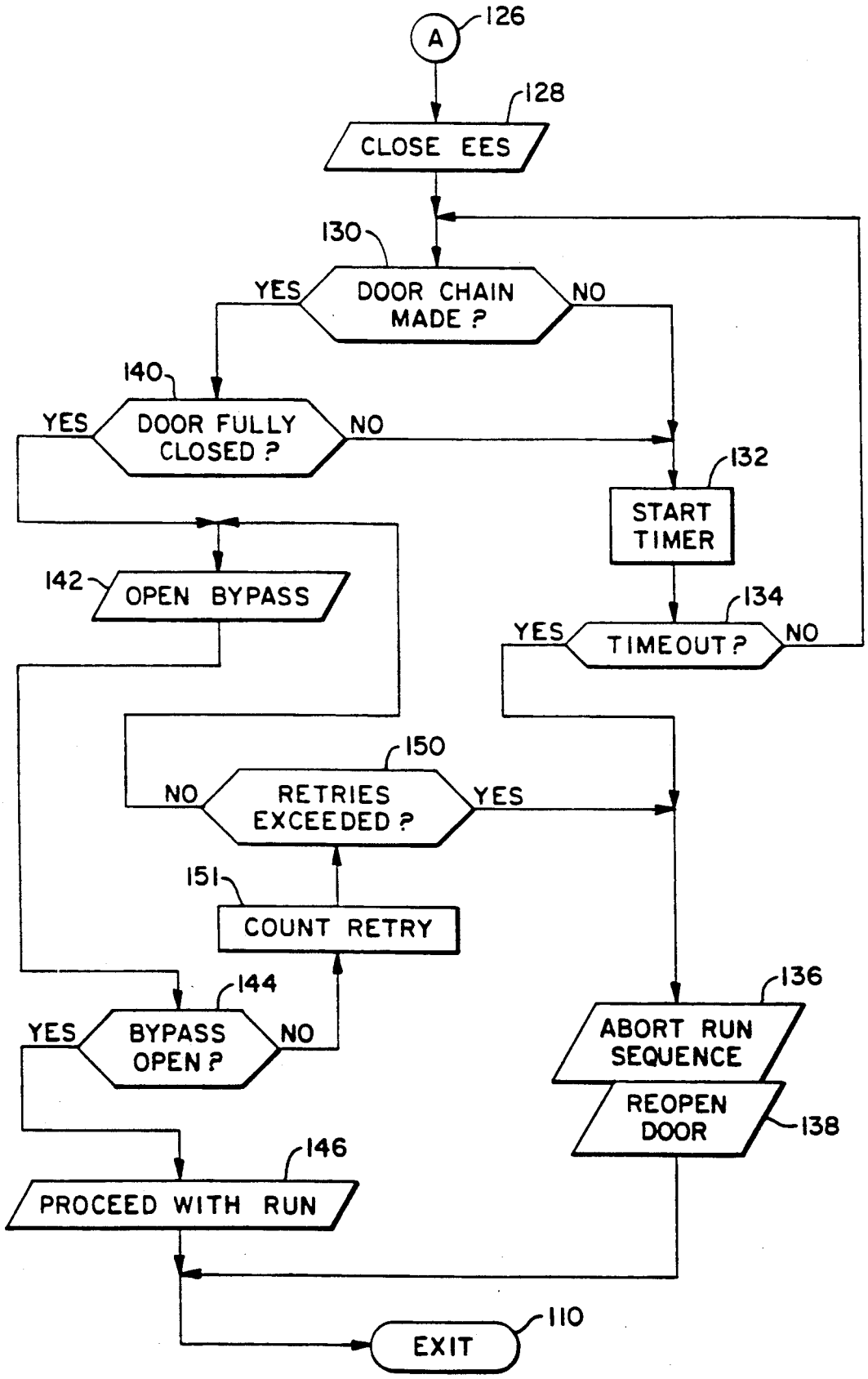

If, on the other hand step 119*a* determines that the door chain relays did in fact drop when the EES contact was opened, a transition is made by a transitional step 126 to the flow chart illustrated in FIG. 3. There, a step 128 is first executed to close the EES checking contact 119 in preparation for an elevator car run. Thus, at this stage, it has been determined that a run is about to begin, the door chain relays are capable of dropping out, and a determination should be made in a step 130 as to whether or not the door chain is made. If not, one of the contacts, for example, 42, 44, 46, . . . 48 may be open circuited and the car should not be allowed to run. However, before aborting the run sequence, a timer is started in a step 132 and the check of steps 130 is reexecuted over and over again until the timer times out as determined in a step 134. If the door chain becomes made before the timer times outs then there is an opportunity to answer the question of step 130 in the affirmative in order to avoid unnecessarily aborting a run sequence.

However, if the timer times out as determined by step 134, a step 136 is next executed and the run sequence is aborted. The door is then reopened and an exit made as indicated by step 110. A reentry at step 100 may then be made or later.

If it were determined in step 130 that the door chain were in fact made (after finding that the door chain dropped properly when the car door was fully open and when the EES contact was opened) then a step 140 is executed to determine whether or not the car door is fully closed. If not, a transition is made to step 132 were the timer is restarted and the question of whether or not the door chain is made is revisited.

If it is determined in step 140 that the door is fully closed, then a step 142 is next executed to open the bypass contacts 88, 90, 92, 94 in the safety chain. A determination is next made in a step 144 as to whether or not the bypass has been opened. This may be checked by auxiliary contacts of DZ (front door zone relay) and RDZ (rear door zone relay) relays and an SS (speed sensing relay or speed checking) relay (not shown). If so, a step 146 is executed in which the run is allowed to proceed and an exit is made in step 110.

If it is determined in step 144 that the bypass is not opened, a count is initiated to attempt to open the bypass until a sufficient number of retries have been executed. This is determined in a step 150 which will keep trying to open the bypass until the count, as counted in a step 151, is exceeded, at which point the run sequence is aborted by executing step 136, step 138 and step 110.

The steps carried out in FIGS. 2 and 3 may be selected to be run in the beginning of the first subframe or the steps may be split among subframes. But regardless of the details of how the steps are carried out, FIGS. 2 and 3 are representative of steps which may be carried out according to the teachings of the present invention in a best mode embodiment thereof.

Notice that the safety chain contacts FGDS, FGDSX and RGDS, RGDSX (rear gate and door status relay and auxiliary) are normally open, making the fail safe state to be such that if power to the door chain is lost, for whatever reason, the safety chain will open and prevent car motion. Notice also that the contacts sensed by the processor 30 are normally closed. This is so that a broken wire in the sense contact circuit can be detected.

To recap, from the description of FIGS. 2 and 3, it will be appreciated that, as part of the "run" prerequisites, the processor 30 executes an EES relay test at the beginning of every run. This involves opening the EES relay checking contact 119 and verifying that, as a result of EES checking contact 119 being opened, the safety chain is opened. Additionally, though not shown, a drive and brake disconnect signal may be checked to ensure it indicates that power is disconnected from the drive and brake circuits. In addition to this, and by virtue of the EES relay contact in the door chain circuit, the FGDS and RGDS inputs to the processor may also be checked at this time to verify the fail safe state can be achieved. Note that a broken or missing wire in the sense contact circuit is detected by virtue of the normally closed contacts and therefore the absence of 115 VAC from the input to the processor. Having passed this test, the EES relay is returned to the picked state and the run sequence is allowed to progress. It can readily be seen that this method provides detection of a shorted FGDS or RGDS relay circuit prior to lifting the brake.

The response to a condition where the processor is unable to perceive the fail safe state (contacts 60, 62 closed) may, e.g., be 10 retries of the EES relay test followed by a shutdown with doors active, to allow passenger exit, and EES checking contact 119 will be left open, opening the safety chain, to assure no further car motion can occur until the situation has been manually resolved.

A broken wire in the door chain will cause the FGDS or RGDS relay to be deenergized and thus prevent car motion. The final permissive for beginning a run (followed by a bypass drop test [not shown]) will be the absence of 115 VAC from the FGDS and RGDS inputs thus requiring the observation of both relay states by software prior to every run. It will be understood that a 115 VAC short to the processor inputs may be detected, among other equivalent methods, by providing a timer as indicated in the step 132 of FIG. 3 and a maximum retry iteration count as indicated in step 134 with respect to waiting for the door chain relays to indicate that the door chain is made.

The FGDS, FGDSX, RGDS and RGDSX contacts are controlled by their respective door chain relay coils which are energized when all the hoistway doors and the car door is closed. Thus, a plurality of hoistway door contacts are wired in series with a car door fully closed contact DFC 168. The car DFC 168 (rear door fully closed [cab]) contact is closed when the car door is fully closed or very nearly so (within several centimeters).

A response to a condition where the processor is unable to obtain a door chain closed indication may, e.g., be three door cycle retries followed by a shutdown with door active and EES open.

It is an important teaching of the present invention that neither the hoistway door closed contacts previously discussed, i.e., 42, 44, 46, . . . , 48, nor a set of similar but rear hoistway door switches 160, 162, 164, . . . , 166 (R1, R2, R3, . . . , RN), nor the front car DFC contact 168, nor a rear door fully closed (RDFC) contact 170 should be closed while the car DFO contact 64 indicates that the car doors are fully open, i.e., the door chain should at such times be open circuited, as indicated by the door chain contacts being open. Thus, if the door chain contacts 60, 62, 65*a*, 65*b* are closed (indicating the door chain is made) while the DFO contact is closed (indicating the car door is fully open) then the signal on line 28 is inhibited or the motor is otherwise prevented from running in a normal manner.

It should be realized that the technique of opening the EES contact to check the health of the door chain relay is a teaching that is broadly applicable to any safety chain and is therefore not restricted to door chains.

Although the invention has been shown and described with respect to an exemplary embodiment thereof, it should be understood that the foregoing and other changes, omissions and additions may be made therein and thereto, without departing from the spirit and scope of the invention.

We claim:

1. Elevator safety circuitry for energizing a safety chain relay for providing a safety chain status signal to a signal processor, comprising:

a plurality of door chain switches wired in series with a door chain relay, responsive to an AC source for energizing said door chain relay for closing a door chain relay permissive contact; and a plurality of safety-related switches, including said door chain relay permissive contact, isolated from said door chain switches in a separate series circuit, responsive to said AC source, for energizing said safety chain relay for providing said safety chain status signal to said signal processor.

2. The circuitry of claim 1, further comprising:

a door chain relay status contact, for opening and closing in response to the respective energization and de-energization of said door chain relay for providing a door chain status signal to said signal processor; and a checking contact wired in series with said door chain switches, responsive to a control signal from said signal processor, for de-energizing said door chain relay.

3. Apparatus for inhibiting movement of an elevator car by sensing a plurality of contacts in series and providing a car motion inhibit signal if one of the contacts is open, comprising:

a plurality of door switches connected in series, responsive to an AC source signal, for providing a door chain relay AC energizing signal if all of said door switches are closed;

a door chain AC relay, responsive to said door chain relay AC energizing signal, for closing a first normally open contact and for opening a normally closed contact which is responsive to said AC source signal for providing a trouble signal when closed;

a plurality of normally open safety contacts connected in series with said first normally open contact, responsive to said AC source signal, for providing a safety chain relay AC energizing signal if all the safety contacts and the first normally open contact are closed and the car motion inhibit signal otherwise; and a safety chain relay, responsive to the safety chain relay AC energizing signal, for closing a normally open relay contact which is responsive to said AC source signal for providing a car motion permissive signal.

4. A method for providing a safety chain status signal to a signal processor for operating an elevator, comprising the steps of:

providing an AC source signal to a plurality of door chain switches wired in series with a door chain relay, for energizing and de-energizing said door chain relay for respectively closing and opening a door chain relay permissive contact; and providing said AC source signal to a plurality of safety-related switches, including said door chain relay permissive contact, isolated from said door chain switches in a separate series circuit, for energizing a safety chain relay for providing said safety chain status signal to said signal processor.

5. The method of claim 4, further comprising the steps of:

providing said AC source signal to a door chain relay status contact, for opening and closing in response, respectively, to said energizing and de-energizing of said door chain relay, for providing a door chain status signal to said signal processor;

providing said AC source to said door chain switches and said door chain relay through a checking contact wired in series with said door chain switches, responsive to a control signal from said signal processor, for de-energizing said door chain relay; and providing a door chain trouble signal in the presence of both said door chain status signal indicating said door chain door switches are closed and said control signal.

6. The method of claim 4, further comprising the step of ensuring that said door chain permissive contact is closed in the presence of a signal indicative of a condition in which all doors should be closed.

7. The method of claim 6, wherein said signal indicative of a condition in which all doors should be closed is a car door fully closed (DFC) signal.

8. The method of claim 6, further comprising the step of:

cycling a car door open and shut in response to said signal indicative of a condition in which all doors should be closed and to said door chain permissive contact being open.

9. The method of claim 6, further comprising the step of ensuring that said door chain permissive contact is open in the presence of a signal indicative of a condition in which at least one door should be open.

10. The method of claim 4, further comprising the step of:

utilizing a reduced voltage for said AC source from that which would otherwise be required to energize said safety chain relay if said door chain switches were wire in series with said safety-related switches.

11. A method for operating an elevator in runs from floor to floor only if a safety chain relay coil in a safety chain is energized, comprising the steps of:

opening a checking contact at the beginning of a run, determining whether said safety chain relay coil de-energized, and inhibiting elevator motion in the event said safety chain relay coil failed to de-energize with said checking contact open.

12. The method of claim 11, further comprising the steps of:

in the event said safety chain relay coil de-energized, closing said checking contact, determining whether said safety chain relay coil is energized, and inhibiting elevator motion in the event said safety chain relay coil is de-energized.

13. The method of claim 11, further comprising the steps of:

in the event said safety chain relay coil de-energized, closing said checking contact, determining whether said safety chain relay coil is energized, and in the event said safety chain relay coil is energized, determining whether said elevator's car doors are fully closed, and in the event said elevator's car doors are fully closed, opening a contact for bypassing a safety chain permissive contact in series with said safety chain relay coil, and proceeding with a run.

14. The method of claim 11, further comprising the steps of:

in the event said safety chain relay coil de-energized, closing said checking contact, determining whether said safety chain relay coil is energized, and in the event said safety chain relay coil remains de-energized, inhibiting elevator motion.

15. A method for operating an elevator car in runs from floor to floor only if an AC safety chain relay coil is energized, comprising the steps of:

determining that said elevator's car doors are fully open and that a door safety chain relay coil is energized, and inhibiting motion of said car.

16. The method of claim 15, further comprising the steps of:

opening a checking contact wired in series with said door safety chain relay coil at the beginning of a run, determining whether said door safety chain relay coil de-energized, and inhibiting elevator motion in the event said door safety chain relay failed to de-energize with said checking contact open.

17. The method of claim 15, further comprising the steps of:

opening a checking contact wired in series with said door safety chain relay coil at the beginning of a run, determining whether said door safety chain relay coil de-energized, in the event said door safety chain relay coil de-energized, closing said checking contact again, determining whether said door safety chain relay coil is energized, and inhibiting elevator motion in the event said safety chain relay coil is de-energized.

18. The method of claim 15, further comprising the steps of:

opening a checking contact wired in series with said door safety chain relay coil at the beginning of a run, determining whether said door safety chain relay coil de-energized, in the event said safety chain relay coil de-energized, closing said checking contact, determining whether said safety chain relay coil is energized, and in the event said safety chain relay coil is energized, determining whether said elevator's car doors are fully closed, and in the event said elevator's car doors are fully closed, opening a contact for bypassing a safety chain permissive contact in series with said safety chain relay coil, and proceeding with a run.

19. The method of claim 15, further comprising the steps of:

opening a checking contact wired in series with said door safety chain relay coil at the beginning of a run, determining whether said door safety chain relay coil de-energized, in the event said safety chain relay coil de-energized, closing said checking contact, determining whether said safety chain relay coil is energized, and in the event said safety chain relay coil is de-energized, inhibiting elevator motion.

* * * * *

UNITED STATES PATENT AND TRADEMARK OFFICE

CERTIFICATE OF CORRECTION

PATENT NO. : 5,107,964

DATED : April 28, 1992

INVENTOR(S) : Steven D. Coste and Eric K. Jamieson

It is certified that error appears in the above-identified patent and that said Letters Patent is hereby corrected as shown below:

On title page, item [54] and col. 1, line 1,

Change Title to: ELEVATOR SAFETY CHAIN WITH DOOR CHAIN PERMISSIVE CONTACT

Signed and Sealed this

Second Day of December, 1997

*Attest:*

Bruce Lehman

BRUCE LEHMAN

*Attesting Officer*

*Commissioner of Patents and Trademarks*